US009878351B2

(12) United States Patent
Gehm et al.

(10) Patent No.: US 9,878,351 B2
(45) **Date of Patent: *Jan. 30, 2018**

(54) METHOD OF CLEANING STEPS OF AN ESCALATOR

(75) Inventors: Patrick C. Gehm, Palm Harbor, FL (US); Michael S. Knight, New Port Richey, FL (US)

(73) Assignee: RENAELC, INC., Houston, TX (US)

( * ) Notice: Subject to any disclaimer, the term of this patent is extended or adjusted under 35 U.S.C. 154(b) by 1209 days.

This patent is subject to a terminal disclaimer.

(21) Appl. No.: 14/343,089

(22) PCT Filed: Aug. 26, 2010

(86) PCT No.: PCT/US2010/002344

§ 371 (c)(1),
(2), (4) Date: Mar. 6, 2014

(87) PCT Pub. No.: WO2011/142736

PCT Pub. Date: Nov. 17, 2011

(65) Prior Publication Data

US 2014/0366915 A1 Dec. 18, 2014

Related U.S. Application Data

(63) Continuation of application No. 12/800,350, filed on May 12, 2010, now Pat. No. 8,337,625.

(51) Int. Cl.

| | |
|---|---|
| ***B08B 1/02*** | (2006.01) |
| ***B66B 31/00*** | (2006.01) |
| ***B08B 1/00*** | (2006.01) |

(52) U.S. Cl.

CPC ..... *B08B 1/02* (2013.01); *B08B 1/006* (2013.01); *B66B 31/003* (2013.01)

(58) Field of Classification Search

CPC ..... A47L 11/00; A47L 13/00; A47L 13/10; A47L 13/16; A47L 13/17; A47L 17/08;

(Continued)

(56) References Cited

U.S. PATENT DOCUMENTS 3,258,809 A * 7/1966 Harvey ..... A47L 13/22 15/321
3,584,329 A * 6/1971 Cravits ..... A47L 7/0009 15/302

(Continued)

FOREIGN PATENT DOCUMENTS

| | | | |
|---|---|---|---|
| EP | 0345900 | A2 | 12/1989 |
| JP | H06 6298479 | A | 10/1994 |
| JP | 200627355 | A | 10/2006 |

*Primary Examiner* — Saeed T Chaudhry
(74) *Attorney, Agent, or Firm* — Roy Kiesel Ford Doody & Thurmon, APLC

(57) ABSTRACT

An escalator step cleaner for cleaning escalator steps having a plurality of parallel tread ridges separated by tread grooves has a cleaning pad assembly configured to extend generally perpendicular to the direction of motion of the escalator steps and clean the escalator steps while the escalator is in motion. The cleaning pad assembly has a rigid upper plate and a flexible disposable bottom pad having a cleaning contact surface. The contact surface carries a plurality of spaced parallel pad ridges separated by pad grooves that matingly engage between the tread ridges of the escalator steps and cause dislodgement of the accumulated debris. The cleaning pad assembly can be secured on a hand-held cleaning tool or on a motorized cleaning tool with rotating brushes and a vacuum.

10 Claims, 6 Drawing Sheets

(58) Field of Classification Search
CPC A47L 25/00; A46B 15/00; A46B 9/02; A46B 9/06; B08B 1/006; B08B 1/02; B66B 31/003
USPC ..... 15/49.1, 256.5, 160, 301, 302; 134/6, 42
See application file for complete search history.

(56) References Cited

U.S. PATENT DOCUMENTS

| | | | | | |
|---|---|---|---|---|---|
| 3,981,596 | A * | 9/1976 | Melton | A47L 11/03 | 15/98 |
| 4,255,827 | A | 3/1981 | Palazzo | | |
| 4,514,872 | A * | 5/1985 | Hopkins | A46B 9/02 | 15/160 |
| 4,538,544 | A * | 9/1985 | Pertl | E04F 21/24 | 118/106 |
| 4,554,295 | A | 11/1985 | Ridge, Jr. | | |
| 4,709,441 | A | 12/1987 | Center | | |
| 5,025,527 | A | 6/1991 | Armstrong | | |
| 5,715,565 | A * | 2/1998 | Kern | A47L 9/02 | 15/302 |
| 8,337,625 | B2 | 12/2012 | Gehm | | |
| 2004/0226577 | A1 | 11/2004 | Schaaf | | |
| 2007/0022555 | A1 * | 2/2007 | Penzes | A47L 13/257 | 15/244.2 |
| 2007/0074362 | A1 * | 4/2007 | Michelson | A47L 13/144 | 15/209.1 |
| 2009/0199868 | A1 * | 8/2009 | Cybulski | A47L 13/022 | 134/6 |
| 2012/0090120 | A1 | 4/2012 | Tuman | | |
| 2012/0227203 | A1 | 9/2012 | Ouellette | | |
| 2015/0259178 | A1 | 9/2015 | Rosenbaum | | |

* cited by examiner

METHOD OF CLEANING STEPS OF AN ESCALATOR

BACKGROUND OF THE INVENTION

This invention relates to a cleaning system, and more particularly, to a system for cleaning steps of an escalator.

Escalators and moving walkways are extensively used in the construction of modern buildings. They are designed to transport people between floors of a building or along stretches of walkways, such as in the airports. Conventionally, the escalator or a walkway is made as an endless chain of steps, which are moved by rotating members at the end of the escalator. Each step is pivotally attached to the support in the chain so they form a moving staircase or walkway. Step escalators have a relatively flat surface on the lower return side of the belt defined by two steps. A similar two-step flat surface is made on the opposite side of the belt to make easier for people to get off the escalators. Rail housings are provided on the opposite sides of the endless belt to guide the steps within a predetermined pathway. The railway housings are stationary.

Almost all modern escalators are provided with non-skid surfaces; the upper surface of the step has a plurality of parallel tread ridges separated by deep tread grooves. The ridges, as well as the grooves tend to accumulate dirt and debris from the movement of traffic on the escalators. The escalators need to be periodically cleaned in order to maintain the sanitary conditions in the building as well as building's aesthetics.

Traditional escalator cleaning techniques require the entire escalator to be dismantled and each step cleaned manually. Such method of escalator cleaning is time consuming and labor intensive. Besides, the escalator has to be shut down during the cleaning process. Some of the buildings, particularly those that stay open 24 hours a day, require that the escalator cleaning be done in the shortest period of time, preferably not requiring hours-long shutdowns.

An alternative is to use a conventional vacuum cleaner or other vacuum device to try to retrieve as much loose dust and accumulated debris from the treads as possible. However, such method of cleaning is ineffective, as the brush of a conventional vacuum cleaner does not reach deep enough into the groove to dislodge the accumulated dirt.

Therefore, a need exists for a system and method for efficiently cleaning the steps of an escalator or a walkway. Such an apparatus and method would preferably provide a means for cleaning the grooves, as well as the ridges and dislodge the accumulated dirt.

SUMMARY OF THE INVENTION

It is, therefore, an object of the present invention to provide a system for cleaning the steps of an escalator or a walkway.

It is another object of the invention to provide a system and method of cleaning the escalator steps that is capable of cleaning the ridges in the treads of the steps as well as the grooves between the ridges.

It is a further object of the invention to provide a system and method for cleaning an escalator or a walkway that would allow cleaning while the escalator or a walkway is in motion.

These and other objects of the invention are achieved through a provision of an escalator or a moving walkway step cleaner for cleaning the steps having a plurality of parallel tread ridges separated by tread grooves. The apparatus has a cleaning pad assembly configured to extend generally perpendicular to the direction of motion of the escalator steps and clean the escalator steps while the escalator is in motion. The cleaning pad assembly has a rigid upper plate and a flexible disposable bottom pad having a cleaning contact surface. The contact surface carries a plurality of spaced parallel pad ridges separated by pad grooves that matingly engage between the tread ridges of the escalator steps and cause dislodgement of the accumulated debris. The cleaning pad assembly can be secured on a hand-held cleaning tool or on a motorized cleaning tool with rotating brushes and a vacuum.

In the embodiment where the cleaning pad assembly is not attached to any cleaning tool, the upper plate is provided with toggle clamps that have telescoping rods extendable to engage opposing rail housings of the escalator. In another aspect, the cleaning pad assembly can pivotally secured to a housing of a motorized cleaning tool to allow pivotal adjustment of the cleaning pad assembly in relation to the escalator steps.

BRIEF DESCRIPTION OF THE DRAWINGS

Reference will now be made to the drawings, wherein like parts are designated by like numerals and wherein.

DETAIL DESCRIPTION OF THE INVENTION

Figure 1:
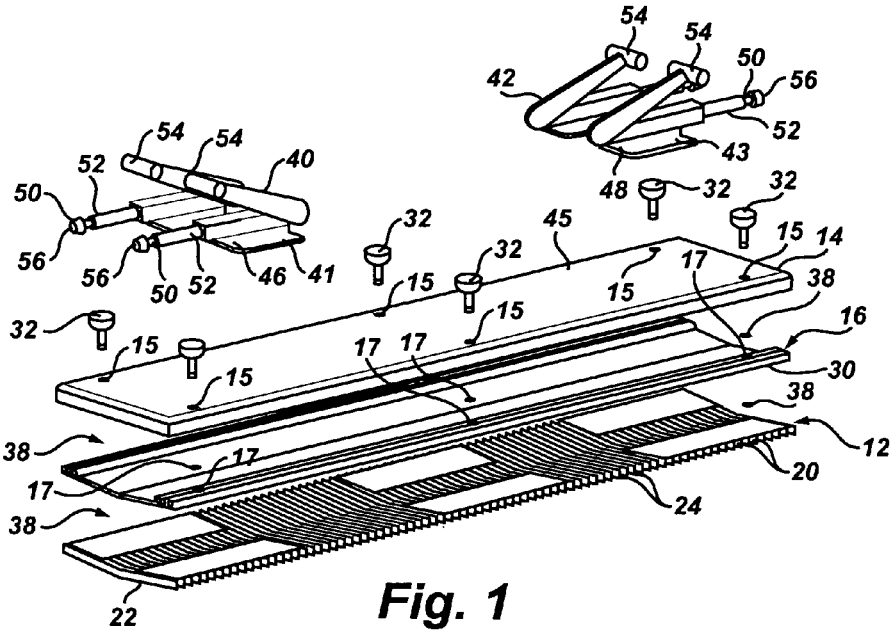
FIG. 1 is an exploded view of a cleaning pad assembly in accordance with the present invention.
Figure 2:
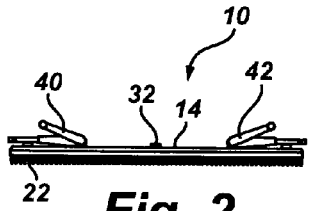
FIG. 2 is a side view of the cleaning pad assembly in accordance with the present invention.
Figure 6:
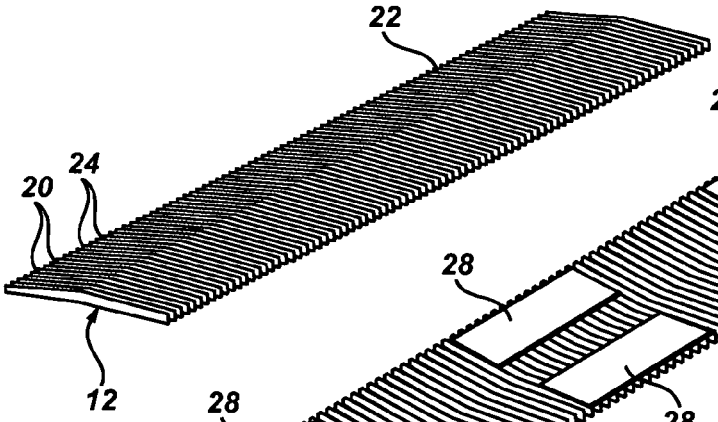
FIG. 6 perspective view of the bottom surface of the bottom pad of the cleaning pad assembly in accordance to the present invention.
Figure 7:
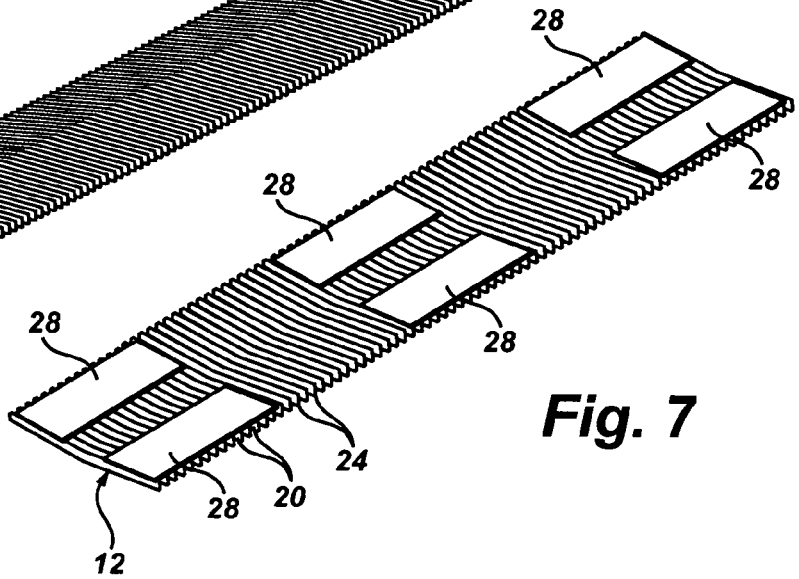
FIG. 7 is a perspective view of the inner surface of the bottom pad of the cleaning pad assembly of the present invention.
Figure 8:
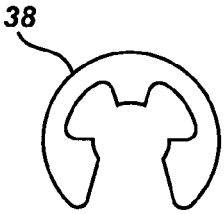
FIG. 8 is a detail top view of a retainer ring used for securing the upper plate and the middle plate of the cleaning plate assembly of the present invention.
Figure 9:
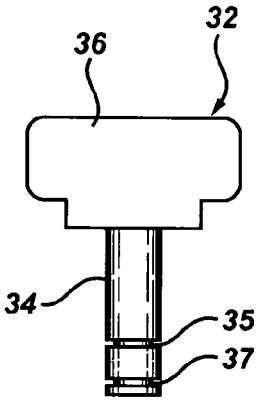
FIG. 9 is a detail front view of a securing knob used for securing the upper plate and the middle plate of the cleaning plate assembly of the present invention.
Figure 10:
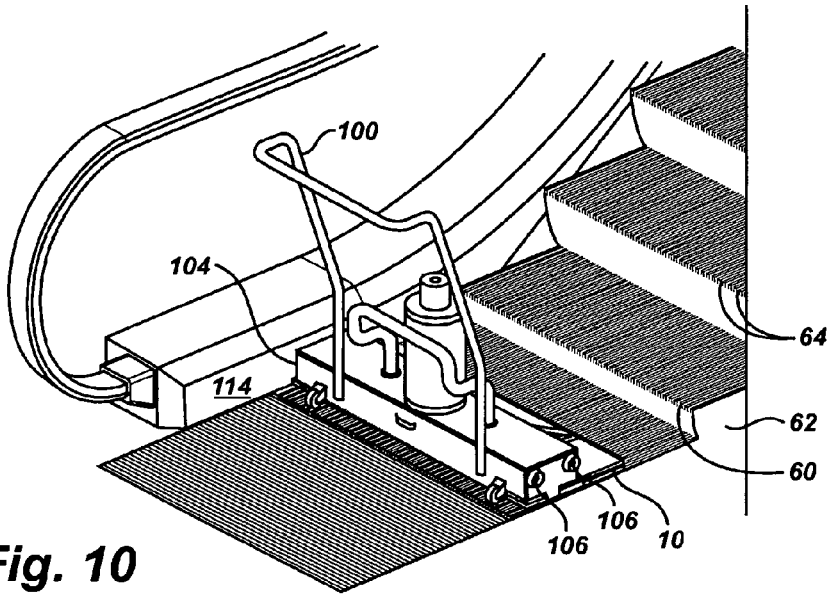
FIG. 10 is a perspective view illustrating the cleaning apparatus of the present invention positioned on bottom steps of an escalator.
Figure 11:
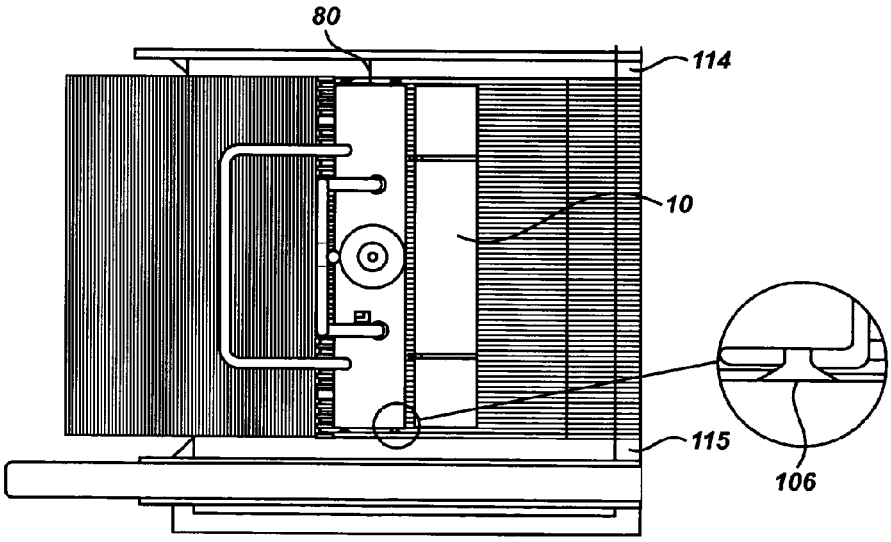
FIG. 11 is a top view illustrating the cleaning apparatus of the present invention positioned on bottom steps of an escalator.
Figure 12:
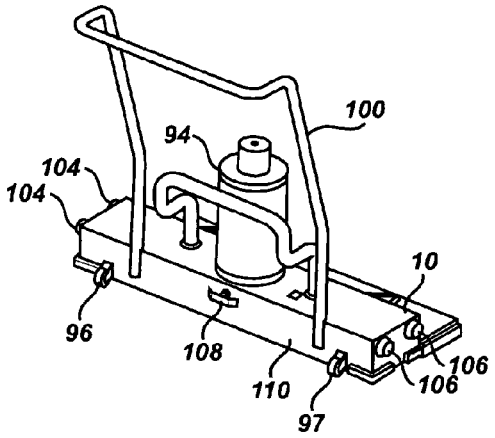
FIG. 12 is a back view of the cleaning apparatus of the present invention, with the cleaning pad assembly used in conjunction with a motorized cleaning tool.
Figure 13:
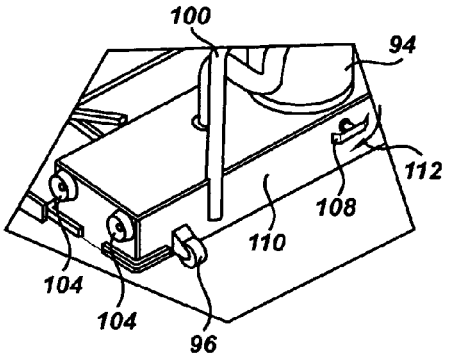
FIG. 13 is a detail view illustrating extendable contact members secured on a housing of the motorized cleaning tool.

Turning now to the drawings in more detail, numeral 10 designates a cleaning pad assembly of the system of the present invention. As can be seen in the drawings, the cleaning pad assembly 10 comprises a bottom pad 12, an upper plate 14, and a middle plate 16 sandwiched between the bottom plate 12 and the upper plate 14. The bottom plate 12 comprises a substantially planar body having a rectangular configuration. In one aspect of the invention, the bottom pad 12 is formed from a flexible porous material, while the upper plate 14 and the middle plate 16 are formed from a rigid material. If desired, the bottom pad 12 and the middle plate 16 could have a slightly curved cross-section, as shown in FIGS. 1 and 6.

A plurality of ridges 20 is formed on a contact surface 22 of the bottom pad 12. The ridges 20 are oriented in a substantial parallel relationship to each other and extend across the entire width of the bottom pad 12. The pad ridges 20 are separated by pad grooves 24 which are sized and configured to extend over tread ridges 60 of an escalator step 62. The pad ridges 20 of the bottom pad 12 are sized and configured to fit into the tread grooves 64 on the escalator step 62 or of a step of a moving walkway.

The vertical dimension of the pad ridges 20 is equal to or slightly larger than the depth of the tread grooves 60 made in the escalator step 62. The top land of each pad ridge 20 is configured to frictionally fit within a tread groove 64, with the faces of the adjacent pad ridges contacting the opposing faces of a tread ridge 60. In the preferred embodiments, the pitch of the pad ridges and grooves matches that of the tread ridges and grooves.

An inner surface 26 of the bottom pad 12 carries a means for securing the bottom pad 12 to the middle plate 18. In one aspect, the securing means comprises a plurality of hook-and-loop fastener strips 28 that are configured to engage with the hook-and-loop fastener strips 30 secured on a bottom of the middle plate 16. In the embodiment shown in FIGS. 1 and 6, eight hook-and-loop fastener strips 28, 30 are provided on each of the adjoining surfaces of the bottom pad 12 and the middle plate 16.

Figure 15:
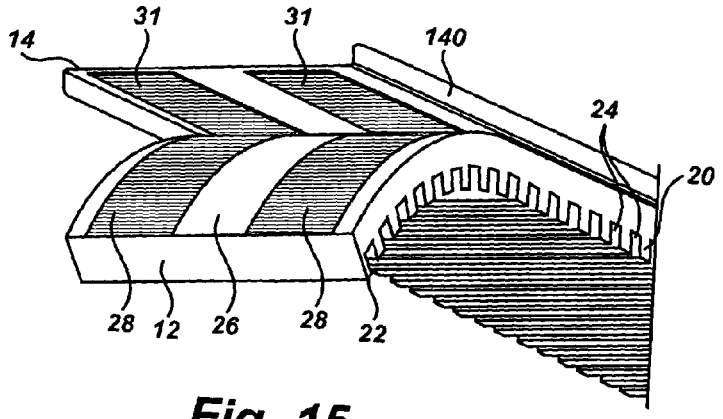
FIG. 15 is detail view illustrating the flexible bottom pad and a rigid upper plate of one embodiment of the cleaning pad assembly of the present invention.
Figure 16:
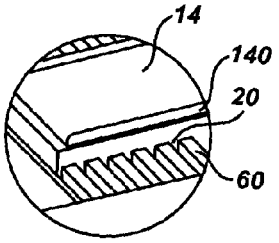
FIG. 16 illustrates engagement of the cleaning pad assembly with the escalator or walkway steps.

In the embodiment shown in FIG. 15, the bottom pad 12 is secured directly to the upper plate 14 using similar hook-and-loop fasteners 28 and hook-and-loop fasteners 31 secured on the contact surface of the upper plate 14.

The securing means in the form of hook and loop fasteners 28, 30 and 31 allow detachable engagement of the bottom pad 12 to the middle plate 16 or the upper plate 14. In one aspect of the invention, the bottom pad 12 is made from a porous moisture-absorbent material capable of collecting the moisture, dirt and debris from the escalator step. A soiled bottom pad is made disposable and easily detachable from the remainder cleaning pad assembly.

The middle plate 16 and the upper plate 14 can be made of a rigid lightweight non-corrosive material, such as metal or plastic, depending on the manufacture's preference. The top plate 14 and the middle plate 14 can be formed as rectangular planar bodies matching in configuration the bottom pad 12.

A plurality of securing members 32 is provided for securing the upper plate 14 with the middle plate 16. Each of the securing members 32 is provided with an exteriorly-threaded stem 34 and an enlarged head 36 that can be manually engaged by the user. The stem 34 is configured to fit into aligned openings 15 and 17 formed in the body of the upper plate 14 and the middle plate 16, respectively. In the exemplary embodiment illustrated in FIG. 1 six such securing members 32 are provided.

The stem 34 of the securing member 32 is provided with a pair of spaced-apart grooves 35 and 37. A retainer snap ring 38 fits into each of the grooves 35 and 37 when the securing member 32 has been inserted through the aligned openings, 15 and 17. When the securing members 32 are inserted into the openings formed in the plates 14, and 16, the groove 37 is positioned between the bottom pad 12 and the middle plate 16, while the groove 35 is positioned between the plates 16 and 14. When the cleaning pad assembly 10 is secured on a cleaning tool, the securing members 32 can be rotated clockwise or counterclockwise to vertically adjust the distance of the bottom pad 12 from the upper plate 14.

The cleaning pad assembly 10 is provided with a means for mounting the assembly between the railway housings of the escalator or a walkway. A pair of toggle clamps 40 and 42 is secured to an top surface 45 of the upper plate 14. The clamps 40 and 42 can be secured by any mechanical means, such as screws or bolts inserted into the upper plate 14. Suitable openings 41 and 43 are formed in the attachment plates 46 and 48 of the clamps 40, 42 respectively. The toggle clamps 40 and 42 are configured to hold the cleaning pad assembly 10 in between the walls 114, 115 defining the railway housings of the escalator or a walkway.

Figure 3:
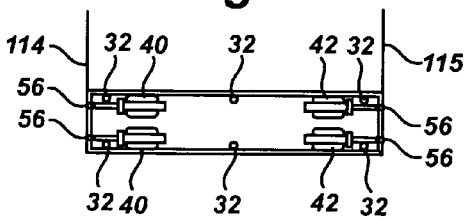
FIG. 3 is a top view of the cleaning pad assembly positioned between railway housings of an escalator or a moving walkway.
Figure 4:
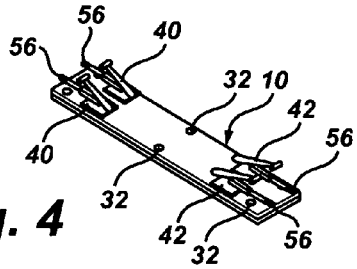
FIG. 4 is a perspective view of the cleaning pad assembly of the present invention.

The clamps 40, 42 are provided with telescopically extendable rods 50 can be adjusted in length, in the order of 1.25 inches. The laterally extending rods 50 telescopically move within guides 52 in response to movement of handles 54 of the toggle clamps 40, 42. A flexible resilient contact member 56 is secured on the free end of each telescoping rod 50. The contact members 56 is configured to engage the opposing walls of the railway housings 114, 115, as shown in FIG. 3, and retain the cleaning pad assembly 10 in place as the escalator steps move against the bottom surface 22 of the bottom pad 12.

In one aspect of the invention, the bottom pad 12 and the plates 14 and 16 are about 32 inches long and approximate in width the width of an escalator or a walkway step, such as for instance 6½ inches. It is envisioned that the combined thickness of the bottom pad 12 and the plates 14 and 16 can be in the order of 1½ inches. Of course, other sizes and dimensions can be selected by the manufacture depending on the intended use of the assembly 10 and the relative size of the escalator steps to be cleaned.

Figure 5:
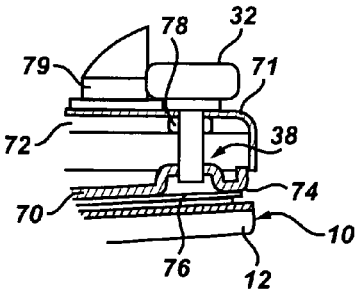
FIG. 5 is a detail cross-sectional view of the cleaning pad assembly mounted on a hand-held tool.

FIG. 5 illustrates an exemplary detachable positioning of the cleaning pad assembly 10 on the housing 72 of a hand-held cleaning tool. The cleaning pad assembly 10 is secured to a base 70 of the housing 72. Hook-and-loop fasteners 74 are secured on the bottom of the base 70 and on the upper plate 14 of the assembly 10. The base 70 is provided with a groove 76 into which the securing member 32 extends. The stem 34 of the securing knob 32 passes through the top housing wall 71 and through an internally threaded bolt 78 which is mounted to the underside of the housing top wall 71. The snap rings 38 engage the stem 34 above and below the base 70. The housing 72 can be secured to a handle 79 which can be engaged by the operator in guiding the cleaning assembly 10 along the escalator steps 62.

Turning now to the embodiment shown in FIGS. 10-21, the cleaning pad assembly 10 is shown secured to a motorized cleaning tool or machine 80, which in this case is a vacuum cleaner. The motorized cleaning tool 80 comprises a motor 82 (FIG. 19) mounted in a housing 84 and driving a rotating brush assembly 86. The brush assembly 86 is provided with a plurality of bristles 88 which are configured to lift the debris dislodged by the cleaning pad assembly 10 and move the debris into a vacuum conduit 90 positioned adjacent the brush assembly 86. The direction of the debris movement is shown by arrows 92 in FIG. 19. The vacuum conduit 90 is operationally connected to a vacuum member 94, which is mounted on the housing 84. The vacuum member 94 comprises a suction assembly and a container for retaining the debris during operation of the equipment. The dust and other accumulated debris can be removed from the vacuum assembly 94 and disposed of in the usual manner.

The housing 84 is provided with a pair of rear wheels 96, 97 and a pair of front wheels (only one front wheel 99 is shown in the drawings). An upwardly extending handle 100 is secured to the housing 84 to allow manipulation of the motorized cleaning tool 80, as well as tilting of the cleaning tool 80 backwards or forwards, as shown by arrows 102 and 103 in FIG. 20.

The cleaning tool 80 is provided with a means for stabilizing position of the cleaning tool between the opposing railway housings 114, 115. A pair of suction cups 104 is secured on an end wall 105 of the housing 84. A similar pair of suction cups 106 is secured on the opposing wall 107 on the housing 84. A pivoting handle 108 is secured on a back wall 110 of the housing 84. Rotation of the handle 108 in the direction of arrow 112 (FIG. 13) causes the suction cups to extend laterally from the housing walls 105 and 107 and engage the opposing walls of the escalator railway housings 114, 115.

The cleaning pad assembly 10 is detachably pivotally secured to the housing 84 by a mounting assembly 120. The mounting assembly 120 comprises an attachment bracket 122 which is configured to be positioned on the front wall 102 of the housing 84 and extend transversely to a longitudinal axis of the housing 84. The attachment bracket 122 has a generally U-shaped configuration (FIG. 17) and receives a pair of attachment bars 123 and 124 therein.

The upper attachment bar 123 is pivotally engaged with the attachment bracket 122 by a pivot pin 125. The lower attachment bar 124 is pivotally engaged with a lower part of the attachment bracket 122 by a pivot pin 126. The free ends of the attachment bars 123 and 124 are pivotally engaged with a mounting bracket 128 which, similarly to the attachment bracket 122 extends vertically, in substantially parallel relationship to the front wall 116 of the housing 84. Pivot pins 129 and 130 pivotally engage the attachment bars 123 and 124, respectively, to the mounting bracket 128.

Figure 19:
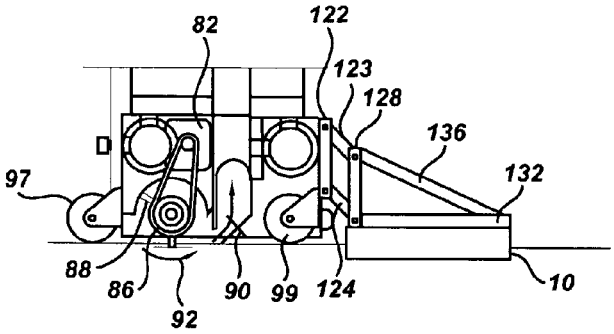
FIG. 19 is a schematic view of the motorized cleaning tool with the cleaning pad assembly secured to the housing.
Figure 20:
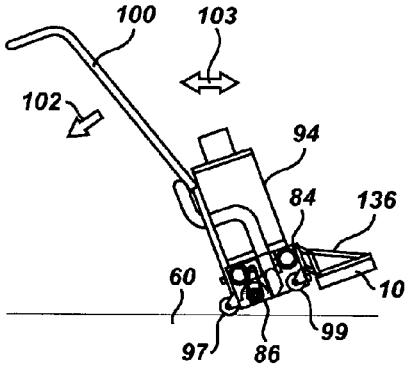
FIG. 20 is a side view of the cleaning system of the present invention illustrating a tilting motion of the motorized cleaning tool.
Figure 21:
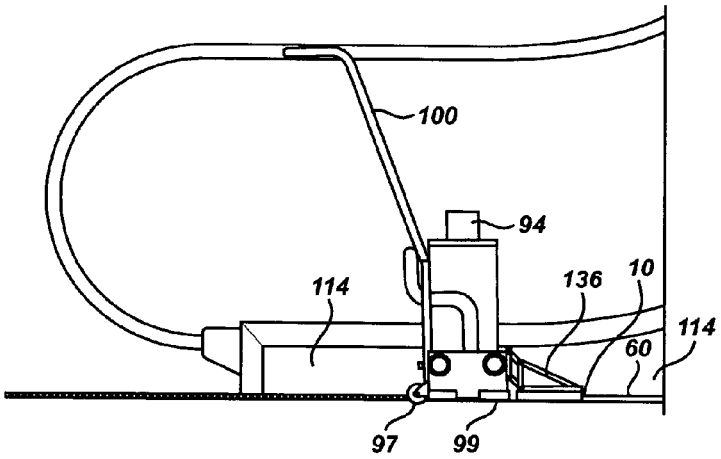
FIG. 21 is a side view of the cleaning system of the present invention positioned on a walkway.

When the cleaning pad assembly is positioned on the steps of an escalator or a walkway, the attachment bars 123, 124 can be pivoted, as shown in FIG. 19, allowing the cleaning pad assembly to be adjusted along a vertical axis. The attachment bracket 122, the mounting bracket 128 and the attachment bars 123, 124 form a parallelogram, with an adjustable distance between the brackets 122 and 128.

A mounting bar 132 is affixed to the upper plate 14 of the cleaning pad assembly 10. The mounting bar 132 extends transversely across the width of the upper plate 14 from the front edge 133 of the plate 14 to an inner edge 134 thereof. The mounting bar 132 is fixedly attached to the mounting bracket 128. A reinforcing bar 136 connects the outermost end of the mounting bar 132 and an upper part of the mounting bracket 128, extending diagonally and forming a right triangle with the mounting bracket 128 and the mounting bar 132. The reinforcing bar 136 is affixed to the mounting bracket 128.

Figure 14:
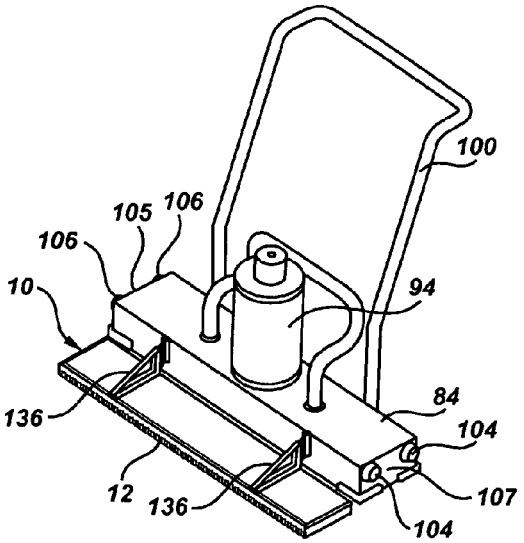
FIG. 14 is a front view of the cleaning apparatus of the present invention, with the cleaning pad assembly used in conjunction with a motorized cleaning tool and showing pivotal movement of the mounting assembly.

The pivotal connection between the attachment bracket 122 and the mounting bracket 128 allows the user to adjust position of the cleaning pad assembly 10 in a vertical direction, moving the ridges 20 of the bottom cleaning pad 12 into the grooves 60 of the escalator steps 62. If desired, the mounting bracket 128 can be provided with a vertical pivot member to allow the cleaning pad assembly 10 to be pivoted in a horizontal plane as well as in a vertical plane. FIG. 14 illustrates such movement of the cleaning pad assembly, when the mounting bar 132 is pivotally engaged with mounting bracket 128 allowing the cleaning pad assembly 10 to move right or left to better align the position of cleaning pad assembly 10 in relation to the tread ridges and tread grooves of the escalator steps 62.

Figure 17:
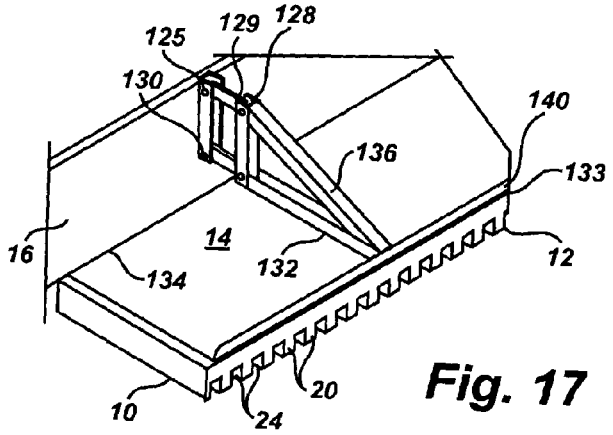
FIG. 17 is a detail view illustrating the mounting assembly for mounting the cleaning pad assembly on the motorized cleaning tool.
Figure 18:
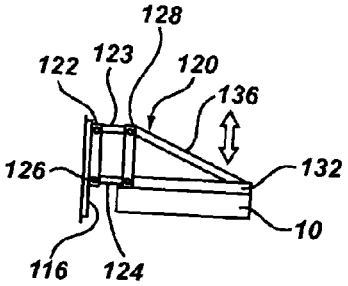
FIG. 18 is a detail side view of the mounting assembly for mounting the cleaning pad assembly on the motorized cleaning tool.

FIG. 15 illustrates an embodiment of the cleaning pad assembly wherein the hook-and-loop fasteners 28 extend substantially along the entire length of the bottom cleaning pad 12. In this embodiment, the bottom cleaning pad 12 is secured directly to the upper plate 14. As can be seen in the drawings, in this embodiment the upper plate 14 is provided with an upwardly extending lip 140, which extends along the length of the upper plate 14. As shown in FIGS. 14 and 17, the mounting bar 132 and the reinforcing bar 136 abut the lip 140.

In use, the motorized cleaning tool 80, with the attached cleaning pad assembly 10 is positioned on the bottom step of the moving escalator, transversely to the direction of travel of the escalator or a moving walkway. The handle 108 is rotated, causing the suction cups 104, 105 to extend from the housing 84 and firmly engage the rail housings 114, 115 of the escalator or a walkway. The position of the cleaning tool 80 is stabilized. The cleaning pad assembly is allowed to be pivotally adjusted so that the ridges and grooves of the bottom pad engage with the grooves and ridges of the steps tread.

As the escalator steps move toward the cleaning tool 80, the pad ridges 20 are guided inside the tread grooves of the escalator steps, causing dislodgement of the debris from the tread grooves, while the tread ridges of the escalator steps fit into the pad grooves 24 of the cleaning pad assembly 10.

Such contact between the horizontally-oriented moving escalator steps and the cleaning pad assembly 10 loosens the dirt which allows the brush assembly 86 to pick up the dirt and direct it into the vacuum conduit 90 to be collected by the suction vacuum 92. If desired, a cleaning liquid can be delivered to the escalator step and mopped up and vacuumed using the cleaning pad 10 and the motorized cleaning tool 80.

The suction cups 104 and 106, as well as the contact members 56 retain the cleaning pad assembly 10 firmly in place in relation to the moving escalator steps. As a result, an efficient cleaning of the escalator steps can be accomplished.

The bottom pad 12 can be easily changed if it becomes damaged or soiled and a new similar pad can be substituted therefore to perform the cleaning operation.

As will be apparent from the description above and the accompanying drawings, the escalator step cleaning assembly 10 singularly, or in combination with a hand held tool or with a motorized cleaning tool forms an effective system for cleaning the steps of an escalator. The cleaning pad assembly 10 has a relatively simple construction and is formed of inexpensive materials. The cleaning pad assembly 10, when used with a hand held tool or with a motorized cleaning tool, utilizes the motion of the escalator itself to perform a cleaning action.

Many changes and modifications can be made in the design of the present invention without departing from the spirit thereof. I therefore, pray that our rights to the present invention be limited only by the scope of the appended claims

We claim:

1. A method of cleaning steps of an escalator, while the escalator is in motion, each of the escalator steps having a plurality of parallel tread ridges separated by tread grooves, the escalator having parallel opposing rail housings for guiding steps of the escalator, the method comprising the following steps: providing a cleaning pad assembly, said cleaning pad assembly comprising a rigid upper plate and a flexible bottom pad having a cleaning contact surface, said contact surface carrying a plurality of spaced parallel pad ridges separated by pad grooves, wherein at least one of said pad ridges is elongated along a line extending substantially parallel to direction of motion of the escalator steps, and at least one of said pad grooves is elongated along a line extending adjacent to and parallel to said at least one of said pad ridges;

positioning said cleaning pad assembly to extend substantially perpendicular to direction of motion of the escalator steps; causing said plurality of pad ridges to frictionally engage within the tread grooves, and causing said plurality of pad grooves to receive tread ridges therein;

dislodging debris from the tread ridges and the tread grooves by contact with the cleaning pad assembly during advance motion of the escalator.

2. The method of claim 1, further comprising a step of detachably securing the bottom pad to the upper plate, and disposing of the bottom pad once it becomes soiled.

3. The method of claim 1, further comprising a step of providing a cleaning tool and securing the cleaning pad assembly on the cleaning tool.

4. The method of claim 3, wherein said cleaning tool is a motorized cleaning tool comprising a housing configured to fit between the rail housings of the escalator, a motor positioned in the housing, a rotating brush assembly and a vacuum assembly mounted in the housing, and wherein said brush assembly directs the dislodged debris to the vacuum assembly, thereby mechanically removing the dislodged debris from the escalator steps.

5. The method of claim 4, wherein said housing supports a plurality of outwardly extendable contact members, and wherein said step of positioning the cleaning pad assembly to extend generally perpendicular to direction of motion of the escalator steps comprises a step of moving the contact members into an extended position and engaging the rail housing of the escalator.

6. The method of claim 3, further comprising a step of providing a means for detachably mounting the cleaning pad assembly on a cleaning tool.

7. The method of claim 6, wherein said mounting means comprises a mounting assembly configured to pivotally support the cleaning pad assembly on the cleaning tool.

8. The method of claim 7, wherein said mounting assembly comprises an attachment bracket secured to the cleaning tool, a pair of spaced-apart attachment bars pivotally connected to the attachment bracket, said attachment bars being configured for pivoting about a vertical axis, a mounting bracket pivotally secured to free ends of the attachment bars, and a mounting bar attached to the upper plate and a lower end of the mounting bracket.

9. The method of claim 1, further comprising a step of retaining the cleaning pad assembly between the rail housings of the escalator during a cleaning operation.

10. The method of claim 9, wherein said step of retaining the cleaning pad assembly between the rail housings of the escalator comprises a step of providing spaced apart clamps secured to the upper plate, said clamps having telescopically extendable rods movable between a retracted position and an extended position, causing said rods to move into the extended position and support the cleaning pad assembly between the rail housings of the escalator by frictionally engaging the opposing rail housings.

* * * * *